US006754916B1

(12) United States Patent
Cox

(10) Patent No.: US 6,754,916 B1
(45) Date of Patent: Jun. 29, 2004

(54) SPAS HAVING A RETRACTABLE ENTERTAINMENT UNIT

(75) Inventor: Wesley O. Cox, Johnstown, NY (US)

(73) Assignee: Saratoga Spa & Bath, Inc., Latham, NY (US)

( * ) Notice: Subject to any disclaimer, the term of this patent is extended or adjusted under 35 U.S.C. 154(b) by 0 days.

(21) Appl. No.: 10/273,450

(22) Filed: Oct. 18, 2002

(51) Int. Cl.[7] ..... A47K 3/00

(52) U.S. Cl. ..... 4/541.1; 4/541.2; 4/541.3; 4/559; 4/546; 4/605; 4/566.1

(58) Field of Search ..... 4/541.1, 559, 546, 4/605, 566.1, 564.1, 541.2, 541.3, 541.4, 541.5

(56) References Cited

U.S. PATENT DOCUMENTS

| | | | | |
|---|---|---|---|---|
| 3,585,991 A | | 6/1971 | Balamuth | 128/66 |
| 4,839,930 A | | 6/1989 | Watkins | 4/546 |
| 6,427,258 B1 | * | 8/2002 | Gooley | 4/566.1 |
| 6,467,103 B1 | | 10/2002 | Gardenier et al. | 4/541.1 |
| 2003/0088912 A1 | * | 5/2003 | Lauter et al. | 4/541.1 |

FOREIGN PATENT DOCUMENTS

| | | |
|---|---|---|
| DE | 32 29 451 | 2/1984 |

OTHER PUBLICATIONS

Gardenier et al., pending U.S. application Ser. No. 10/268,371, filed Oct. 10, 2002, entitled "A Head Rest Assembly Having An Illuminated Insert For A Spa".

* cited by examiner

*Primary Examiner*—Henry Bennett
*Assistant Examiner*—Azy Kokabi
(74) *Attorney, Agent, or Firm*—Heslin Rothenberg Farley & Mesiti P.C.

(57) ABSTRACT

A spa includes a housing having a tub for holding water, and a retractable entertainment unit having a display. The housing includes an upper portion having a seal surface extending around the tub. The entertainment unit is releasably retractable through an opening in the upper surface and movable between a) a retracted position wherein the display is hidden from view and a top of the entertainment unit is disposed below and laterally outward from the seal surface, and b) an extended position wherein the top is raised above the seal surface and the display is visible.

29 Claims, 7 Drawing Sheets

SPAS HAVING A RETRACTABLE ENTERTAINMENT UNIT

FIELD OF THE INVENTION

This invention relates, generally, to spas and, more particularly, to spas having a retractable entertainment unit.

BACKGROUND OF THE INVENTION

Spas such as hot tubs have enjoyed increased popularity in recent years. Spas typically provide a means for bathers to relax in a controlled environment of warmth and gentle water massage.

In conventional spas, the tub is generally formed of rigid material and permanently mounted or fixed either in ground or above ground at a specific location. Spas generally have a number of fluid flow outlets or nozzles. Each nozzle usually jets water or a water-air froth into the tub.

In addition, conventional spas can be further enhanced by the use of other amenities which provide an environment more conducive to relaxation. For example, spas have been provided with electronic devices. A drawback with the use of an electronic device with a spa is the likelihood of damage to the electronic device from exposure to water or moisture present about the tub.

One attempt has included to fixedly mounting audio components such as speakers in an elevated position above the spa and the surface of the water. Other attempts have included using moisture-tolerant speakers such as marine-type speakers.

There is a need for further spas which include a retractable entertainment unit.

SUMMARY OF THE INVENTION

The present invention provides in a first aspect, a spa having a housing having a tub for holding water, and an entertainment unit. The housing includes an upper portion having a seal surface extending around the tub. The entertainment unit is releasably retractable through an opening in the upper surface and movable between a) a retracted position wherein a top of the entertainment unit is disposed below and laterally outward from the seal surface, and b) an extended position wherein the top is raised above the seal surface and the entertainment unit is visible.

The present invention provides in a second aspect, a spa having a housing having a tub for holding water, and an entertainment unit having a display. The housing includes an upper portion having a seal surface extending around the tub and a second portion defining a surface disposed below and laterally outward from the seal surface. The second surface has an opening and a raised ridge disposed around the opening. The second surface is open along a laterally outward side of the housing. The entertainment unit is releasably retractable through an opening in the upper surface and movable between a) a retracted position wherein the display is hidden from view and a top of the entertainment unit is disposed below and laterally outward from the seal surface, and b) an extended position wherein the top is raised above the seal surface and the display is visible.

The present invention provides in a third aspect, a spa having a housing having a tub for holding water, and an entertainment unit having a display. The entertainment unit is releasably retractable through an opening in the upper portion and movable between a) a retracted position wherein the display is hidden from view and a top of the entertainment unit is disposed below and laterally outward from the seal surface, and b) an extended position wherein the top is raised above the seal surface and the display is visible. A support assembly is provided for supporting and guiding the entertainment unit between the retracted position and the extended position. The support assembly includes a gas cylinder for raising the entertainment unit from the retracted position to the extended position. An upper mount is attached to the entertainment unit and a lower mount is attached to a lower portion of the support assembly. An upper end of the gas cylinder is receivable in the upper mount and a lower end of the gas cylinder is receivable in the lower mount.

The present invention provides in a fourth aspect, a spa having a housing having a tub for holding water, and an entertainment unit having a display. The housing includes an upper portion having a seal surface extending around the tub and a second portion defining a surface disposed below and laterally outward from the seal surface. The second surface has an opening and a raised ridge disposed around the opening. The second surface is open along a laterally outward side of the housing. The entertainment unit is releasably retractable through an opening in the upper surface and movable between a) a retracted position wherein the display is hidden from view and a top of the entertainment unit is disposed below and laterally outward from the seal surface, and b) an extended position wherein the top is raised above the seal surface and the display is visible. A support assembly is provided for supporting and guiding the entertainment unit between the retracted position and the extended position. The support assembly includes a gas cylinder for raising the entertainment unit from the retracted position to the extended position. An upper mount is attached to the entertainment unit and a lower mount is attached to a lower portion of the support assembly. An upper end of the gas cylinder is receivable in the upper mount and a lower end of the gas cylinder is receivable in the lower mount.

The present invention provides in a fifth aspect, a spa having a housing having a tub for holding water, and a compartment. The housing includes an upper portion having a seal surface extending around the tub. The compartment is retractable through an opening in the upper surface and movable between a) a retracted position wherein the compartment is hidden from view and a top of the compartment is disposed below and laterally outward from the seal surface, and b) an extended position wherein the top is raised above the seal surface and the compartment is visible.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and accompanying drawings in which:

DETAILED DESCRIPTION OF THE INVENTION

Figure 1:
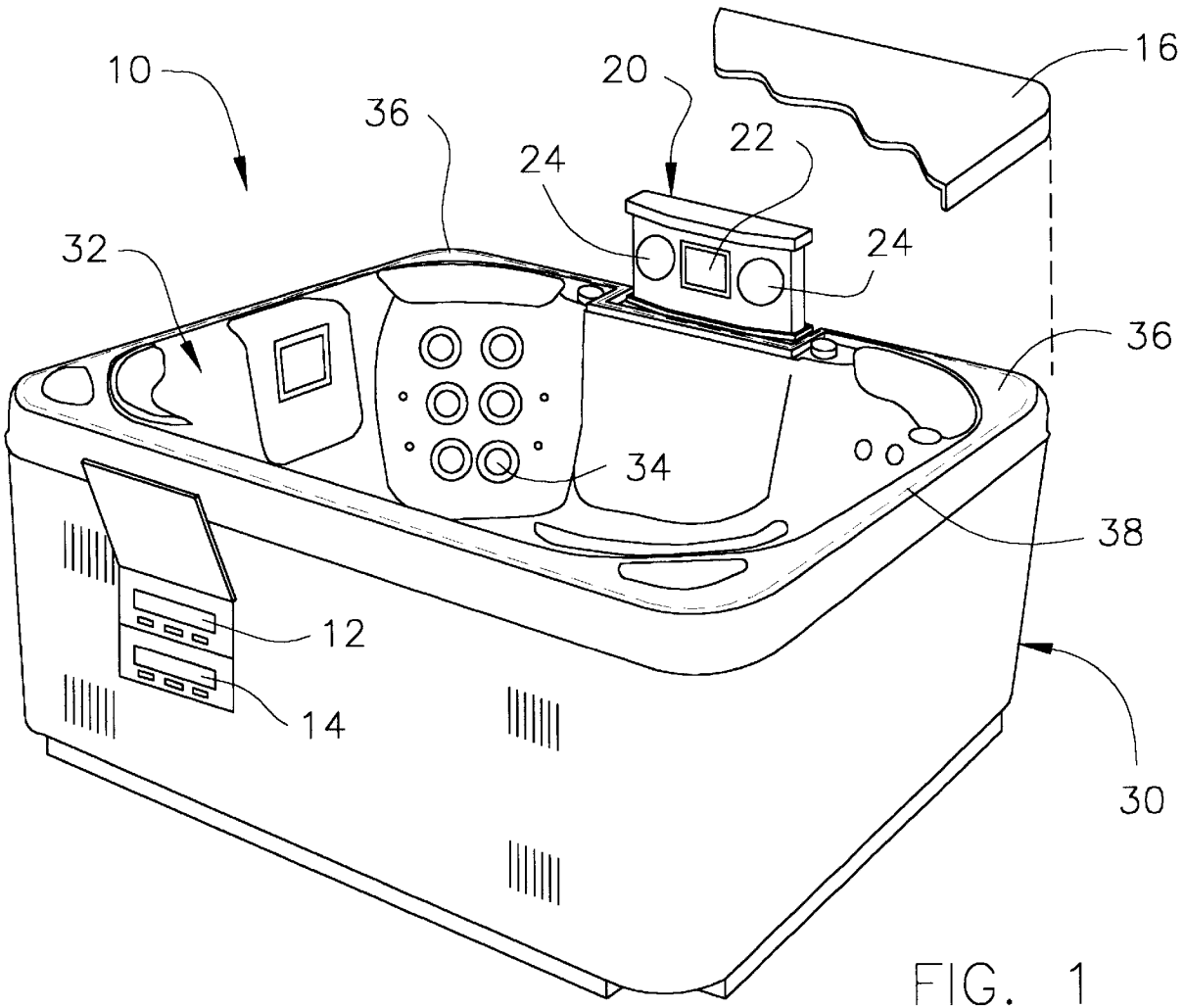
FIG. 1 is a perspective view of a spa having a retractable entertainment unit in accordance with the present invention.

FIG. 1 illustrates a spa 10 having a retractable entertainment unit 20 in accordance with the present invention. Entertainment unit 20 may include a display 22 such as a video display and two audio speakers 24. A video cassette player 12 and/or a digital video disc player 14, or stereo or other electronic device may be operably connected to entertainment unit 20. As explained in greater detail below, spa 10 is configured so that entertainment unit 20 may be disposed in an extended or visible position, and in a retracted or hidden position to avoid the likelihood of water coming into contact with the entertainment unit.

Although the term "spa" is used throughout this description, it is to be understood that the present invention is applicable to spas, hot tubs, pools, and other fluid bearing recreational or therapeutic devices. In addition, although spa 10, shown in FIG. 1, is large enough to accommodate about four bathers, the present invention is applicable to any size spa, having any number of bathers or occupants, for example, spas having one or more bathers, or four or more bathers, or even eight or more bathers. In addition, it is to also be understood that the present invention is also directed to spa having a retractable compartment instead of the retractable entertainment unit. For example, the compartment may provide for storage, or support a portable radio or other device. In addition, the compartment may include one or more shelves.

Spa 10 includes a housing 30 having a tub 32 for holding water and one or more water-jets 34. The fluid is typically pressurized, for example, by at least one pump (not shown). The spa may also include suitable valves, piping, heaters, water conditioners, electronics and controls (not shown). In addition, the spa may also be operably connected to a source of electrical power.

Figure 2:
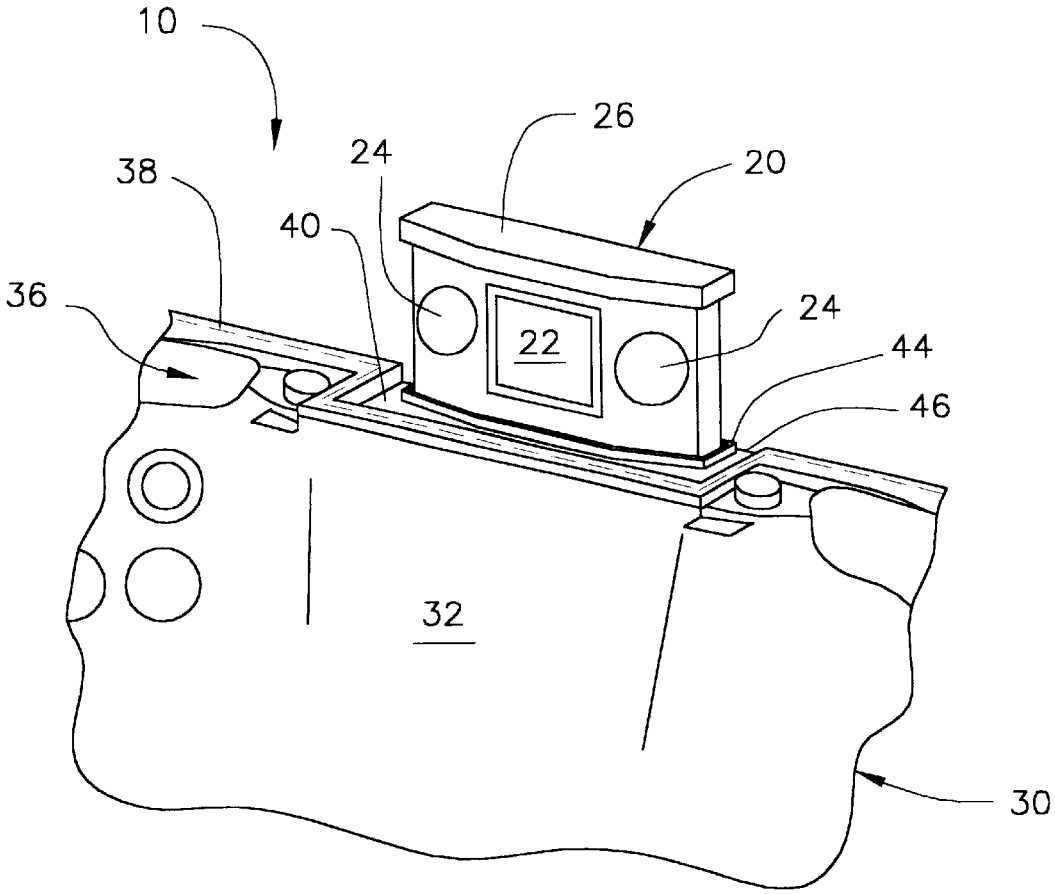
FIG. 2 is an enlarged perspective view of a portion of the spa of FIG. 1 with the retractable entertainment unit in an extended visible position.

With reference to FIGS. 1 and 2, housing 30 includes an upper portion 36 which defines a seal surface 38 (shown in dashed lines) extending around tub 32. Spa 10, when not in use, may be covered with a cover 16 (only a portion of which is shown in FIG. 1). Seal surface 38 is generally a level surface which when cover 16 rests on seal surface 38, water is retained in tub 32, particularly when spa 10 is periodically operated to agitate and circulate the water.

Figure 3:
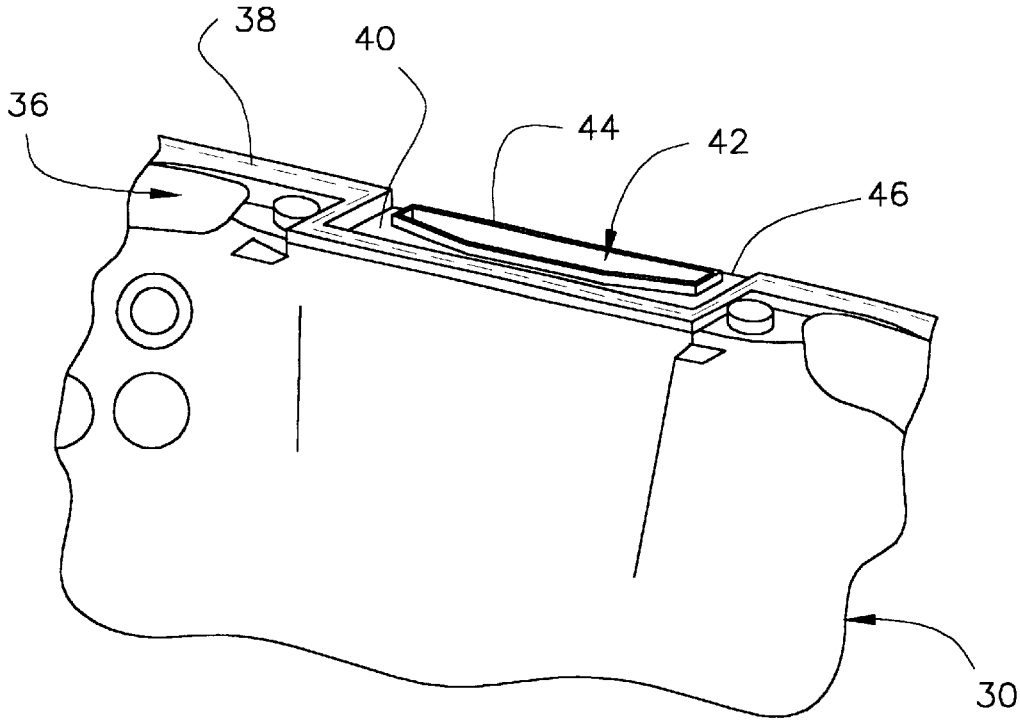
FIG. 3 is an enlarged perspective view of a portion of the spa similar to FIG. 2 with the retractable entertainment unit removed.

As best shown in FIGS. 2 and 3, upper portion 36 includes a second surface 40 disposed below and laterally outward from seal surface 38. Second surface 40 includes an opening 42 (FIG. 3) and a raised ridge 44 disposed around opening 42. The raised ridge and the upper portion of the housing may be separate pieces which are assembled or integrally formed as one piece. Second surface 40 may also be opened along a laterally outward side 46 of housing 30.

Figure 4:
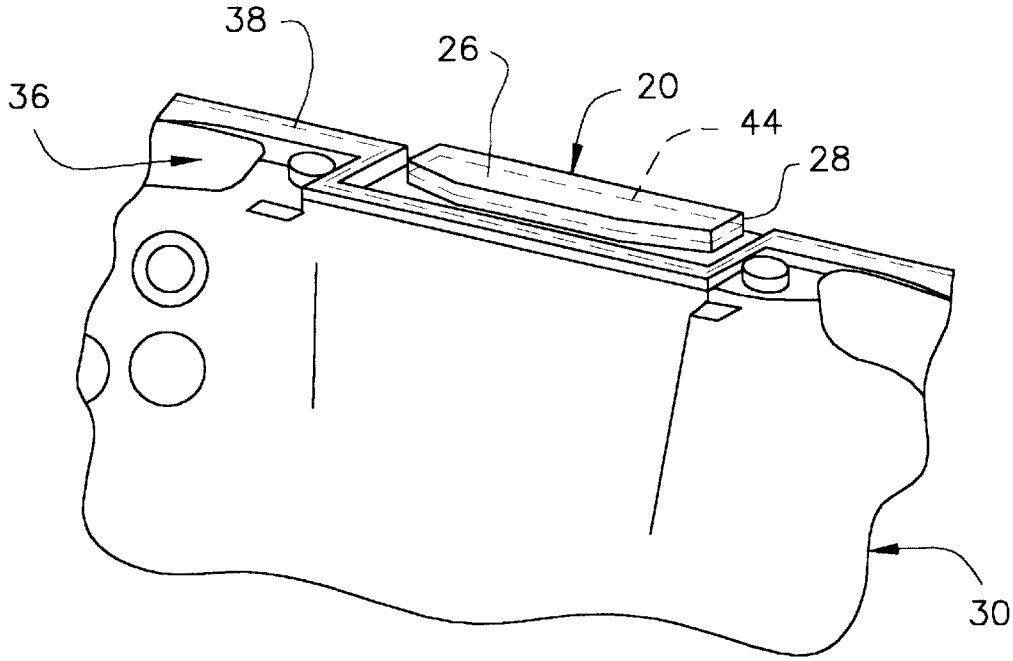
FIG. 4 is an enlarged perspective view of a portion of the spa similar to FIG. 2 with the entertainment unit in a retracted hidden position.

With reference to FIG. 4, a top 26 of entertainment unit 20 includes a downwardly-depending flange 28 (best shown in FIGS. 6 and 7) which extends around and over raised ridge 44 when the entertainment unit is disposed in a retracted position. The combination of the seal surface, the raised ridge, and the second surface being opened along a laterally outward side results in draining water away from the second surface.

As shown in FIGS. 2–4, entertainment unit 20 (FIGS. 2 and 3) is releasably retractable through opening 42 (FIG. 3) in upper portion 36 of housing 30 and movable between a retracted position (FIG. 4) wherein the display and the speakers are hidden from view and top 26 (FIGS. 2 and 3) of entertainment unit 20 is disposed below and laterally outward from seal surface 38, and an extended position (FIG. 2) wherein top 26 is raised above seal surface 38 and display 22 and speakers 24 are visible.

Figure 5:
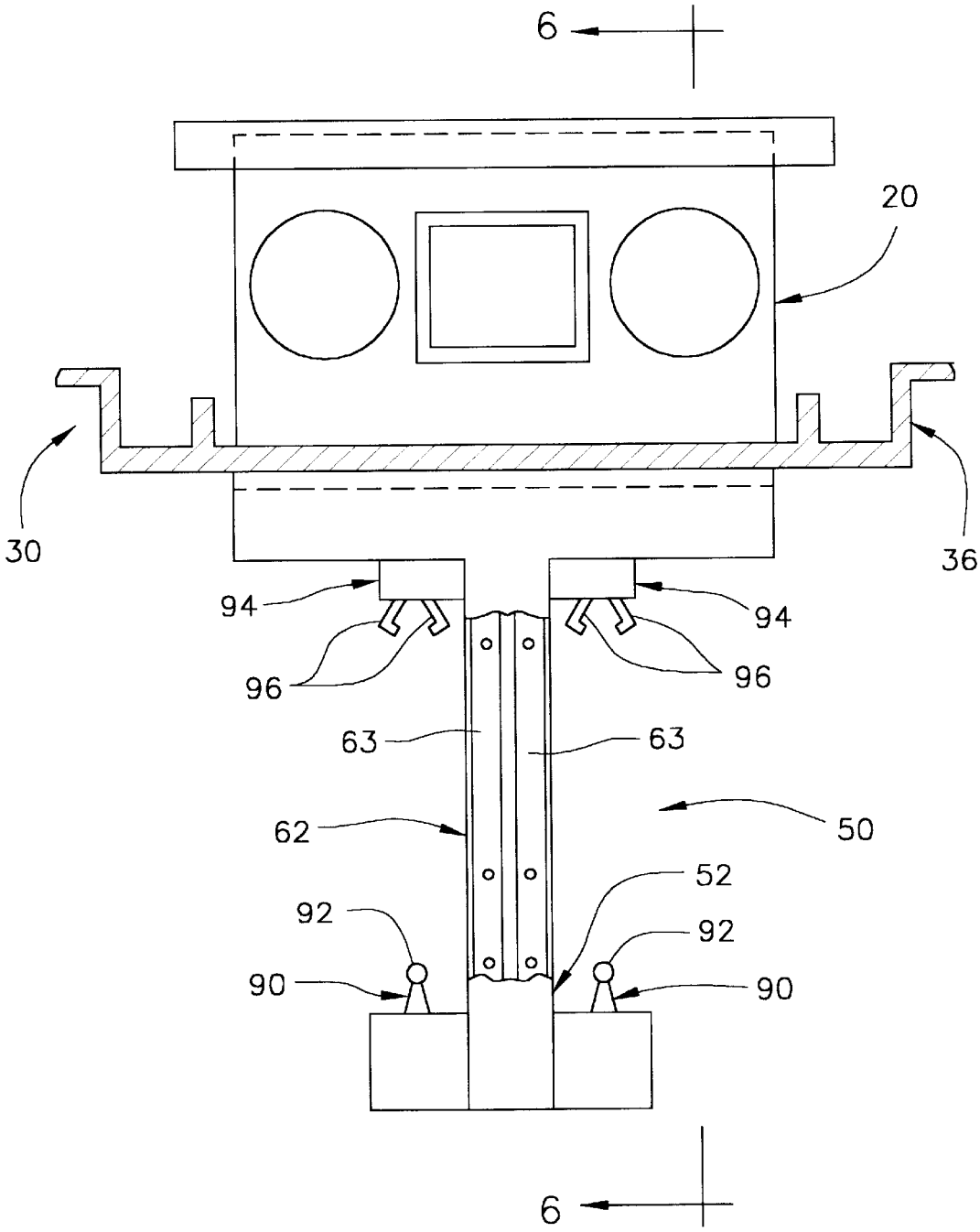
FIG. 5 is an enlarged front elevational view, in part section, of a portion of the spa of FIG. 1 illustrating the support assembly with the entertainment unit in an extended visible position.
Figure 6:
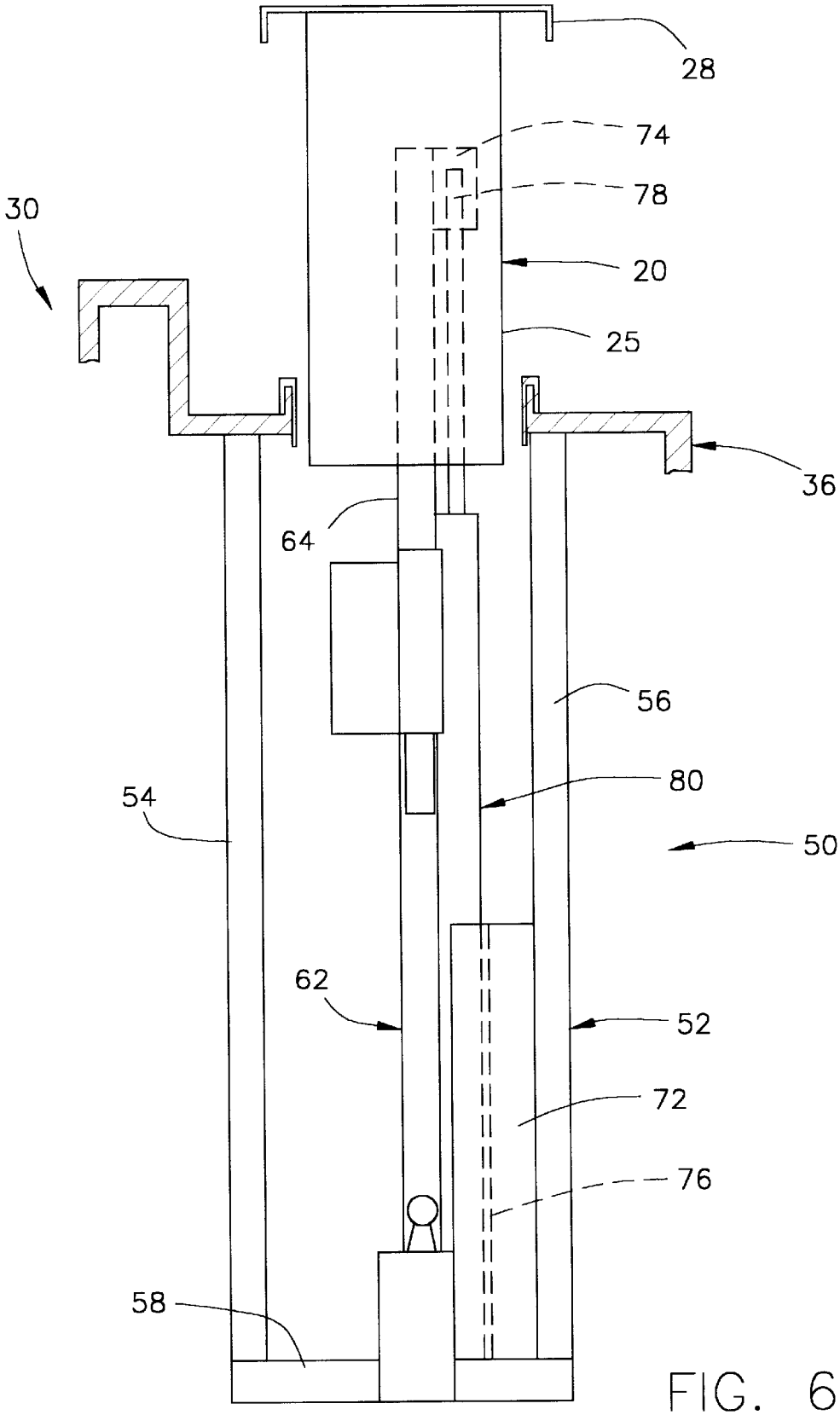
FIG. 6 is an enlarged cross-sectional view taken along line 6—6 of FIG. 4 illustrating the support assembly with the entertainment unit in an extended visible position.
Figure 7:
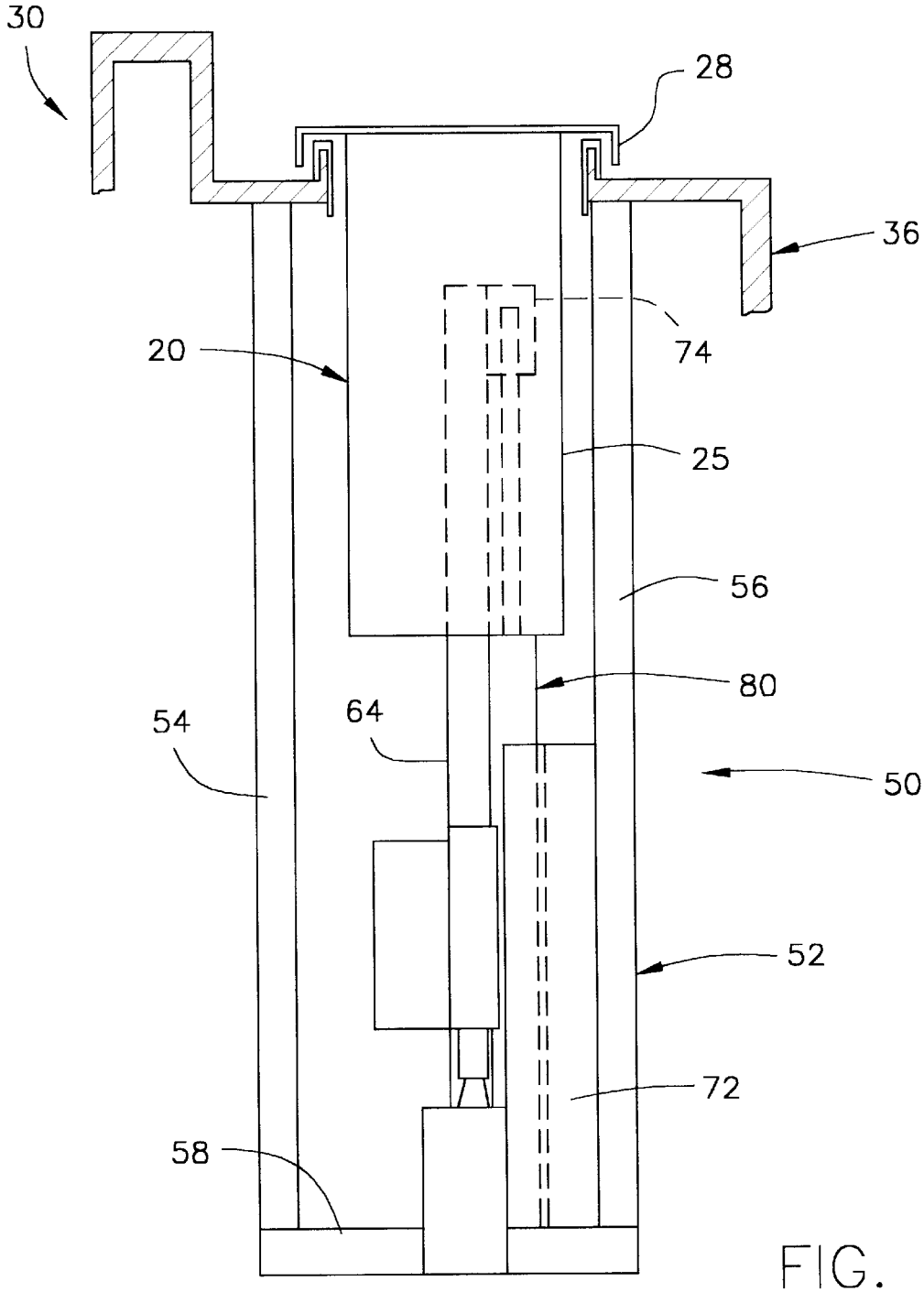
FIG. 7 is an enlarged cross-sectional view along line 6—6 of FIG. 4 illustrating the support assembly with the entertainment unit in retracted hidden position.

With reference to FIGS. 5–7, a support assembly 50 supports and guides entertainment unit 20 between an extended position (FIGS. 5 and 6) and retracted position (FIG. 7). Support assembly 50 includes a generally U-shaped support 52 having a pair of legs 54 and 56 (FIGS. 6 and 7) attached at their upper ends to upper portion 36 of housing 30, and a middle portion 58 (FIGS. 6 and 7) which connects to the lower ends of legs 54 and 56.

Support assembly 50 includes a fixed track portion 62 (FIG. 5) and a movable track portion 64 (FIGS. 6 and 7). Fixed track portion 62 (FIGS. 5 and 6) is attached at its lower end to middle portion 58 of U-shaped support 52 and includes a pair tracks 63 (FIG. 5). Movable track portion 64 includes a plurality of rollers (not shown) which are retained in tracks 63 and slidable along fixed track portion 62. An upper end of movable track portion 64 is attached to entertainment unit 20.

Support assembly 50 may include a lower mount 72 (FIGS. 6 and 7) attached to middle portion 58 and an upper mount 74 (FIGS. 6 and 7) attached to an upper portion of movable track portion 64. Mounts 72 and 74 may include recesses 76 and 78 (FIGS. 6 and 7), respectively, for receiving opposite ends of a gas cylinder 80 for raising entertainment unit 20 from a retracted position to an extended position.

With such a set-up employing a gas cylinder and mounts with recesses, should the gas cylinder become inoperable, a new gas may be readily replaced. For example, in the extended position of the entertainment unit, a rear portion 25 (FIGS. 6 and 7) of entertainment unit 20 may be removed to expose upper mount 74. With the rear portion removed, gas cylinder 80 may be easily removed by forcing the upper end of the piston of the gas cylinder downwardly and out of the recess in upper mount 74. Likewise, a new gas cylinder may be easily installed by placing the lower end of the cylinder portion of the gas cylinder into the recess in the lower mount, pressing the upper end of the piston of the gas cylinder downwardly and into the recess in the upper mount. Thereafter the rear cover of the entertainment may be replaced.

As best shown in FIG. 5, support assembly 50 may also include a pair of latches for releasably locking entertainment unit 20 in a retracted position. For example, the latches may include a pair of upwardly-extending projections 90 having a spherical portion 92 attached to middle potion 58 (FIGS. 6 and 7) of U-shaped support 52. The latches may also include a pair of catches 94 may be attached to the lower portion of movable track portion 64 (FIGS. 6 and 7) and include a pair of gripping arms 96. When a user presses entertainment unit 20 downwardly, fluid in gas cylinder compresses and, catches 94 engage and lock onto projections 90 to hold entertainment unit 20 in a retracted position. Upon the user then pressing the top of the entertainment unit to move the entertainment slightly downwardly a small distance, catches 94 opens and allows entertainment unit 20 to be raised by the action and extension of gas cylinder 80.

Figure 8:
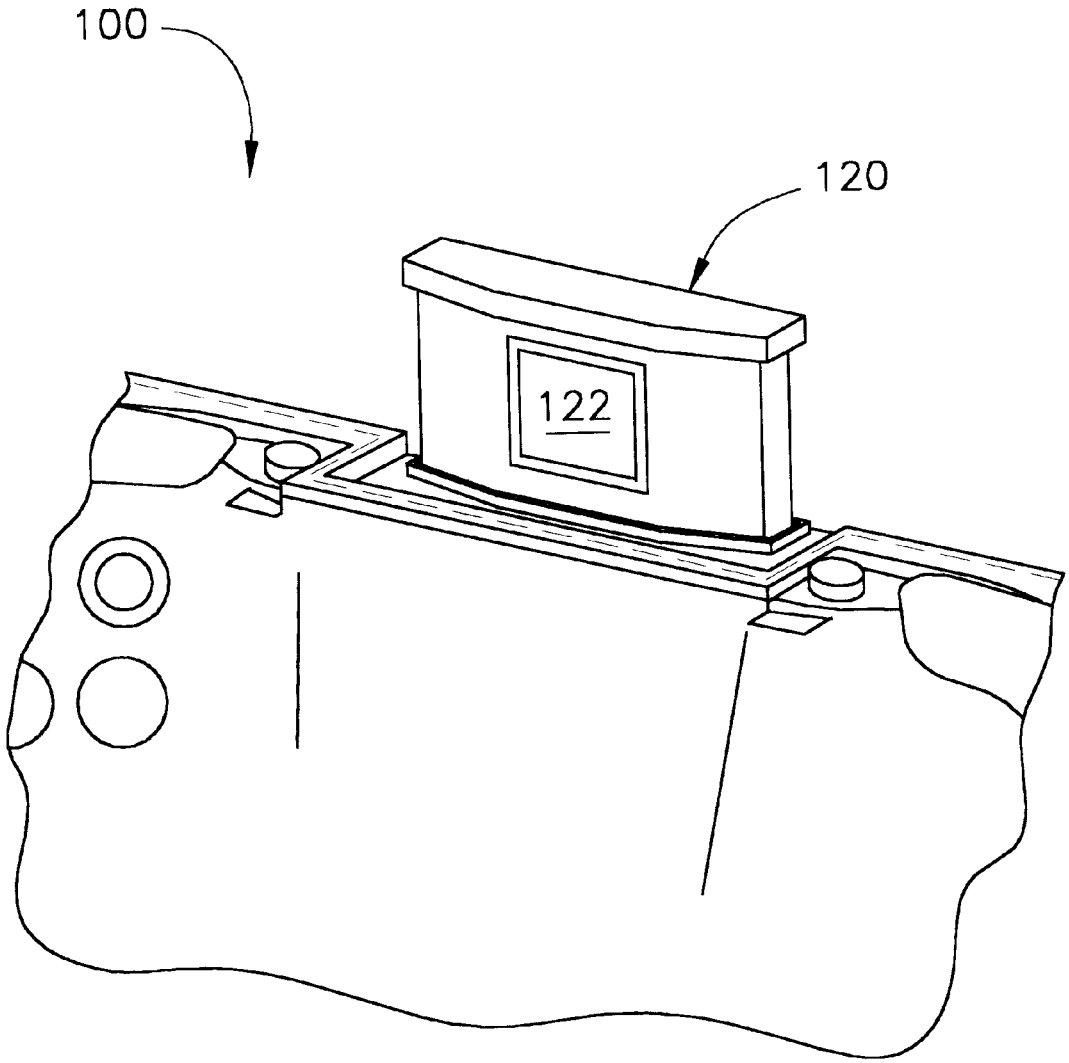
FIG. 8 is a perspective view of a portion of another spa in accordance with the present invention with the retractable entertainment unit in an extended visible position.

FIG. 8 is a perspective view of a portion of a spa 100 in accordance with the present invention. Spa 100 is similar to spa 10 with the exception that a retractable entertainment unit 120 includes a display 122. For examples, one or more speakers may be located away from retractable entertainment unit 120.

A suitable gas cylinder is manufactured and available from Industrial Gas Springs, Inc. of West Chester, Pa., model number GS3298-1 0402. It will be appreciated that other suitable compression means, e.g., coil springs, may be employed. The latches may be suitable cabinet door latches, e.g., "push" or "touch" type latches and magnetic latches.

The speakers may be conventional audio speakers or marine-type, for example, speakers having one or more vibrating membranes, for example, woofers, tweeters, subwoofers, etc. that can produce audible sound. The display may be a video display such as a cathode ray tube display or liquid crystal display. Other electronic devices connectable to the entertainment unit may include a radio, a stereo, a tape player, a compact disc player, an MP3 player, a television receiver, a computer, or any other electronic component or combinations thereof capable of producing a sound signal for the speakers and/or a video signal for the display. The electronic device or devices may also be integral to the entertainment unit and/or signals may be transmitted to the entertainment unit from a remote location.

From the present description, it will be appreciated by those skilled in the art that by providing a retractable entertainment unit, the nominal height of the spa housing is not increased.

Thus, while various embodiments of the present invention have been illustrated and described, it will be appreciated by those skilled in the art that many changes and modifications may be made thereunto without departing from the spirit and scope of the invention.

What is claimed is:

1. A spa comprising:

a housing having a tub for holding water, said housing having an upper portion comprising a seal surface extending around said tub;

an entertainment unit retractable through an opening in said upper surface and movable between a) a retracted position wherein a top of said entertainment unit is disposed below and laterally outward from said seal surface, and b) an extended position wherein said top is raised above said seal surface and said entertainment unit is visible;

a support assembly for supporting and guiding said entertainment unit between said retracted position and said extended position;

said support assembly comprising a gas cylinder for raising said entertainment unit from said retracted position to said extended position; and said support assembly comprising at least one latch for releasably locking said entertainment unit in said retracted position with said gas cylinder being compressed.

2. The spa as recited in claim 1 wherein said upper portion comprises a second surface which defines said opening, and said second surface being disposed below and laterally outward from said seal surface.

3. The spa as recited in claim 2 wherein said second surface is open along a laterally outward side of said housing.

4. The spa as recited in claim 2 further comprising a raised ridge disposed around said opening.

5. The spa as recited in claim 4 wherein said top of said entertainment unit comprises a downwardly-depending flange which extends around said raised ridge when said entertainment unit is disposed in said retracted position.

6. The spa as recited in claim 5 wherein said downwardly-depending flange is spaced from said raised ridge when said entertainment unit is disposed in said retracted position.

7. The spa as recited in claim 1 wherein said top of said entertainment unit and said downwardly-depending flange are movable downwardly in said retracted position for unlocking said at least one latch.

8. The spa as recited in claim 1 wherein said support assembly comprises an upper mount having a recess attached to an upper portion of said support and a lower mount having a recess attached to a lower portion of said support assembly, and an upper end of said gas cylinder being receivable in said recess of said upper mount and a lower end of said gas cylinder being receivable in said recess of said lower mount.

9. The spa as recited in claim 1 wherein said at least one latch comprises a catch having a pair of gripping arms attached to an upper portion of said support assembly which engages a projection attached to a lower portion of said support assembly.

10. The spa as recited in claim 1 wherein said entertainment unit comprises a display.

11. The spa as recited in claim 10 further comprising at least one of a video cassette recorder, a digital video disc player, and a television receiver disposed in said housing and connectable to at least one of said display.

12. The spa as recited in claim 1 wherein said entertainment unit comprises a display and at least one speaker.

13. A spa comprising:

a housing having a tub for holding water, said housing having an upper portion comprising a seal surface extending around said tub;

a compartment retractable through an opening in said upper surface and movable between a) a retracted position wherein said compartment is hidden from view and a top of said compartment is disposed below and laterally outward from said seal surface, and b) an extended position wherein said top is raised above said seal surface and said compartment is visible;

a support assembly for supporting and guiding said compartment between said retracted position and said extended position;

said support assembly comprising a gas cylinder for raising said compartment from said retracted position to said extended position; and said support assembly comprising at least one latch for releasably locking said compartment in said retracted position with said gas cylinder being compressed.

14. The spa as recited in claim 13 wherein said upper portion comprises a second surface which defines said opening, and said second surface being disposed below and laterally outward from said seal surface.

15. The spa as recited in claim 14 wherein said second surface is open along a laterally outward side of said housing.

16. The spa as recited in claim 14 further comprising a raised ridge disposed around said opening.

17. The spa as recited in claim 16 wherein said top of said compartment comprises a downwardly-depending flange which extends around said raised ridge when said compartment is disposed in said retracted position.

18. The spa as recited in claim 17 wherein said downwardly-depending flange is spaced from said raised ridge when said compartment is disposed in said retracted position.

19. The spa as recited in claim 13 wherein said top of said entertainment unit and said downwardly-depending flange are movable downwardly in said retracted position for unlocking said at least one latch.

20. The spa as recited in claim 13 wherein said support assembly comprises an upper mount having a recess attached to an upper portion of said support and a lower mount having a recess attached to a lower portion of said support assembly, and an upper end of said gas cylinder being receivable in said recess of said upper mount and a lower end of said gas cylinder being receivable in said recess of said lower mount.

21. The spa as recited in claim 13 wherein said at least one latch comprises a catch having a pair of gripping arms attached to an upper portion of said support assembly which engages a projection attached to a lower portion of said support assembly.

22. A spa comprising:

a housing having a tub for holding water, said housing having an upper portion comprising a seal surface extending around said tub and a second portion defining a surface disposed below and laterally outward from said seal surface, said second surface having an opening and a raised ridge disposed around said opening, said second surface being open along a laterally outward side of said housing;

a compartment retractable through said opening in said upper surface and movable between a) a retracted position wherein said compartment is hidden from view and a top of said compartment is disposed below and laterally outward from said seal surface, and b) an extended position wherein said top is raised above said seal surface and said compartment is visible;

said top of said compartment comprising an outer downwardly-depending flange which extends around and is spaced-apart from said raised ridge when said entertainment unit is disposed in said retracted position.

23. The spa as recited in claim 22 further comprising a support assembly for supporting and guiding said entertainment unit between said retracted position and said extended position, said support assembly comprising a gas cylinder for raising said entertainment unit from said retracted position to said extended position, and said support assembly comprising at least one latch for releasably locking said entertainment unit in said retracted position.

24. A spa comprising:

a housing having a tub for holding water, said housing having an upper portion comprising a seal surface extending around said tub and a second portion defining a surface disposed below and laterally outward from said seal surface, said second surface having an opening and a raised ridge disposed around said opening, said second surface being open along a laterally outward side of said housing;

an entertainment unit comprising a display, said entertainment unit retractable through said opening in said upper surface and movable between a) a retracted position wherein said display is hidden from view and a top of said entertainment unit is disposed below and laterally outward from said seal surface, and b) an extended position wherein said top is raised above said seal surface and said display is visible; and said top of said entertainment unit comprises an outer downwardly-depending flange which extends around and is spaced-apart from said raised ridge when said entertainment unit is disposed in said retracted position.

25. The spa as recited in claim 24 further comprising at east one of a video cassette recorder, a digital video disc player, and a television receiver disposed in said housing and connectable to at least one of said display.

26. A spa comprising:

a housing having a tub for holding water, said housing having an upper portion defining a seal surface extending around said tub and a second surface disposed below and laterally outward from said seal surface, said second surface having an opening and a raised ridge disposed around said opening, said second surface being open along a laterally outward side of said housing;

an entertainment unit comprising a display, said entertainment unit retractable through said opening in said upper surface and movable between a) a retracted position wherein said display is hidden from view and a top of said entertainment unit is disposed below and laterally outward from said seal surface, and b) an extended position wherein said top is raised above said seal surface and said display is visible, said top of said entertainment unit comprises an outer downwardly-depending flange which extends around and is spaced-apart from said raised ridge when said entertainment unit is disposed in said retracted position; and a support assembly for supporting and guiding said entertainment unit between said retracted position and said extended position, said support assembly comprising a gas cylinder for raising said entertainment unit from said retracted position to said extended position, an upper mount attached to said entertainment unit and a lower mount attached to a lower portion of said support assembly, and an upper end of said gas cylinder being receivable in said upper mount and a lower end of said gas cylinder being receivable in said lower mount.

27. The spa as recited in claim 26 further comprising at least one of a video cassette recorder, a digital video disc player, and a television receiver disposed in said housing and connectable to at least one of said display.

28. A spa comprising:

a housing having a tub for holding water, said housing having an upper portion comprising a seal surface extending around said tub; and an entertainment unit retractable through an opening in said upper surface and movable between a) a retracted position wherein a top of said entertainment unit is disposed below and laterally outward from said seal surface, and b) an extended position wherein said top is raised above said seal surface and said entertainment unit is visible;

a support assembly for supporting and guiding said entertainment unit between said retracted position and said extended position;

said support assembly comprising compression means for raising said entertainment unit from said retracted position to said extended position;

said support assembly comprising at least one locking means for releasably locking said entertainment unit in said retracted position; and wherein said support assembly is movable downwardly to compress said compression means, and said at least one latch assembly is operable to maintain said compression means under compression when in said retracted position.

29. A spa comprising:

a housing having a tub for holding water, said housing having an upper portion comprising a seal surface extending around said tub;

a compartment retractable through an opening in said upper surface and movable between a) a retracted position wherein said compartment is hidden from view and a top of said compartment is disposed below and laterally outward from said seal surface, and b) an extended position wherein said top is raised above said seal surface and said compartment is visible, a support assembly for supporting and guiding said compartment between said retracted position and said extended position;

said support assembly comprising compression means for raising said compartment from said retract position to said extended position;

said support assembly comprising locking means for releasably locking and holding said compartment in said retracted position; and wherein said compression means and said locking means cooperate together so that when said support assembly is moved downwardly to compress said compression means, said locking means releasably locks and holds said compression means under compression in said retracted position.

* * * * *

UNITED STATES PATENT AND TRADEMARK OFFICE

CERTIFICATE OF CORRECTION

PATENT NO. : 6,754,916 B1
DATED : June 29, 2004
INVENTOR(S) : Cox

It is certified that error appears in the above-identified patent and that said Letters Patent is hereby corrected as shown below:

Column 8,
Line 10, delete the word “east” and insert -- least --

Signed and Sealed this

Tenth Day of August, 2004

JON W. DUDAS
*Acting Director of the United States Patent and Trademark Office*